US009265139B2

(12) United States Patent
Pacquet et al.

(10) Patent No.: US 9,265,139 B2
(45) Date of Patent: Feb. 16, 2016

(54) ELECTRON CYCLOTRON RESONANCE IONISATION DEVICE

(75) Inventors: Jean-Yves Pacquet, Capbreton (FR); Laurent Maunoury, Caen (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 321 days.

(21) Appl. No.: 13/996,466

(22) PCT Filed: Dec. 20, 2011

(86) PCT No.: PCT/EP2011/073434

§ 371 (c)(1),
(2), (4) Date: Sep. 9, 2013

(87) PCT Pub. No.: WO2012/084968

PCT Pub. Date: Jun. 28, 2012

(65) Prior Publication Data

US 2014/0001983 A1 Jan. 2, 2014

(30) Foreign Application Priority Data

Dec. 21, 2010 (FR) ..... 10 60984

(51) Int. Cl.

| | |
|---|---|
| ***H05H 13/00*** | (2006.01) |
| ***H01J 27/18*** | (2006.01) |
| ***H01J 41/12*** | (2006.01) |
| *H05H 7/08* | (2006.01) |

(52) U.S. Cl.

CPC ..... *H05H 13/005* (2013.01); *H01J 27/18* (2013.01); *H01J 41/12* (2013.01); *H05H 2007/082* (2013.01)

(58) Field of Classification Search

None

See application file for complete search history.

(56) References Cited

U.S. PATENT DOCUMENTS

| | | | | |
|---|---|---|---|---|
| 4,641,060 | A * | 2/1987 | Dandl | H05H 1/18 313/161 |
| 5,292,370 | A * | 3/1994 | Tsai | H01J 37/32082 118/715 |
| 6,194,836 | B1 * | 2/2001 | Pacquet | H01J 27/18 118/723 MA |

(Continued)

FOREIGN PATENT DOCUMENTS

EP 0 527 082 B1 2/1993

OTHER PUBLICATIONS

Vodopianov A et al; "Glow plasma trigger for electron cyclotron resonance ion sources", Review of Scientific Instruments, AIP, Melville, NY, US, vol. 81, No. 2, Feb. 5, 2010, pp. 2A305-2A305.

(Continued)

*Primary Examiner* — Tung X Le
*Assistant Examiner* — Srinivas Sathiraju
(74) *Attorney, Agent, or Firm* — Pillsbury Winthrop Shaw Pittman LLP

(57) ABSTRACT

An electron cyclotron resonance ionization device includes a sealed vacuum chamber configured to contain a plasma, an electromagnetic wave injector to inject an electromagnetic wave into the sealed chamber, a magnetic structure for generating a magnetic field in the chamber and for generating a plasma along the magnetic field lines, the modulus of the magnetic field forming a magnetic mirror structure, with at least one electron cyclotron resonance region. The sealed chamber is a waveguide having a length that is greater than or equal to the guide wavelength corresponding to the frequency of the injected electromagnetic wave, and the plasma is ignited without prior injection of gas.

19 Claims, 5 Drawing Sheets

(56) References Cited

U.S. PATENT DOCUMENTS

| | | | | |
|---|---|---|---|---|
| 8,693,637 | B2 * | 4/2014 | Lee | H05G 2/003 378/119 |
| 8,760,055 | B2 * | 6/2014 | Pacquet | H05H 3/02 315/111.81 |
| 8,835,871 | B2 * | 9/2014 | Delferriere | H01J 27/18 250/423 F |
| 8,994,258 | B1 * | 3/2015 | Kaufman | H01J 27/146 313/231.31 |
| 2003/0122492 | A1 * | 7/2003 | Dandl | H01J 41/20 315/111.91 |
| 2011/0140641 | A1 * | 6/2011 | Won | H01J 27/18 315/502 |
| 2011/0210668 | A1 * | 9/2011 | Pacquet | H05H 3/02 315/111.81 |
| 2013/0327954 | A1 * | 12/2013 | Delferriere | H01J 27/18 250/423 R |

OTHER PUBLICATIONS

Vodopyanov A V et al; "He2+ source based on Penning-type discharge with electron cyclotron resonant heating by millimeter waves", Plasma Sources Science and Technology Institute of Physics Publishing Bristol, GB, vol. 20, No. 3, Apr. 19, 2011.

International Search Report as issued for PCT/EP2011/073434.

* cited by examiner

ELECTRON CYCLOTRON RESONANCE IONISATION DEVICE

CROSS-REFERENCE TO RELATED APPLICATIONS

This is the U.S. National Stage of PCT/EP2011/073434, filed Dec. 20, 2011, which in turn claims priority to French Patent Application No. 1060984, filed Dec. 21, 2010, the entire contents of all applications are incorporated herein by reference in their entireties.

FIELD

The present invention relates to an electron cyclotron resonance (ECR) particle ionisation device.

BACKGROUND

In electron cyclotron resonance sources, the ions are obtained by ionisation of the particles of a gaseous medium formed by one or more gases, metal vapours or molecules in vapour phase, contained in an axially symmetrical sealed enclosure, by means of a plasma of electrons highly accelerated by electron cyclotron resonance.

Electron cyclotron resonance is obtained due to the combined action of a high-frequency (HF) electromagnetic wave injected into the enclosure and of a magnetic field of which the modulus structure corresponds to a structure of the magnetic mirror type, referred to as a minimum B structure. The profile of the magnetic mirror structure has at least two maxima ($B_{max}$) on the abscissas, arranged respectively in the regions of injection and extraction of the source, and a minimum ($B_{min}$) arranged between the two maxima ($B_{max}$).

The two maxima ($B_{max}$) have a value greater than the value of the magnetic field ($B_{res}$) for which electron cyclotron resonance satisfying the condition $B_{res}=f\cdot 2\pi m/e$ is achieved, where e represents the electron charge, m represents the electron mass, and f represents the frequency of the HF electromagnetic wave.

The minimum ($B_{min}$) has a value equal to or less than the value for which electron cyclotron resonance is achieved.

Waveguide-type electron cyclotron resonance sources of multicharged ions, such as the source described in patent EP 0527082, are known.

In patent EP 0527082, the introduction of the high-frequency electromagnetic wave can be ensured, both by a coaxial transition and by direct injection, from rectangular or circular fundamental mode waveguides. According to the described invention, the enclosure, in its mid-plane, has a cross section substantially equal to that of the waveguide ensuring the injection of the electromagnetic field into the enclosure and the propagation of the wave in the enclosure referred to as a waveguide enclosure.

The use of the enclosure as a waveguide enables the propagation of the HF wave in any confinement enclosure and thus the formation of a plasma at the place where the ECR conditions are combined.

Patent EP 0527082 also proposes the use of a specific arrangement of axially symmetrical permanent magnets, making it possible to avoid the use of solenoids and making it possible to produce a simple source of small size.

However, the use of these ion sources requires the injection of a gas or of a metal vapour into the confinement enclosure in order to initiate and maintain the electron cyclotron resonance plasma. The gas has to be injected into the enclosure under conditions that make it possible to ensure a minimum pressure of approximately $10^{-4}$ mbar in the confinement enclosure in order to ensure the ignition of the plasma.

The use of this type of ion source thus results in the need for control and adjustment of the pressure in the confinement enclosure before the injection of the gas so as to achieve the pressure required for the ignition of the plasma.

SUMMARY

Based on the above, the object of the present invention is to provide an ionisation device making it possible to avoid the injection of a gas into the enclosure prior to the ignition of the plasma and also to avoid the need to control the pressure of the enclosure at a pressure of approximately $10^{-4}$ mbar.

The device according to the invention has numerous applications in the fields of science, medicine, ion production, implantation, microgravure, vacuum coating, etc.

To this end, the invention proposes an electron cyclotron resonance ionisation device comprising:

- a sealed vacuum chamber intended to contain a plasma,
- means for injecting an electromagnetic wave into said sealed chamber;
- and a magnetic structure for generating a magnetic field in said chamber and for generating a plasma along the magnetic field lines, the modulus of said magnetic field forming a magnetic mirror structure with at least one electron cyclotron resonance region;

said device being characterised in that said sealed chamber is a waveguide, of which the length L is greater than or equal to the guide wavelength corresponding to the frequency of the injected electromagnetic wave.

A sealed vacuum chamber means a chamber in which a working pressure less than or equal to $10^{-4}$ mbar prevails.

Waveguide length means the length Lg defined by the following relationship:

$$Lg = \frac{c}{\sqrt{(frequency_{working}^2 - frequency_{interruption}^2)}}$$

where:

- c corresponds to the speed of light, expressed in kilometers/second;
- $frequency_{working}$ corresponds to the frequency of the injected electromagnetic wave, expressed in MHz;
- $frequency_{interruption}$ corresponds to the frequency for which the power transmitted is attenuated by −3 dB, expressed in MHz.

The interruption frequency is defined in accordance with the following relationship:

$$frequency_{interruption} = \frac{1.841 \cdot c}{(\pi \cdot D)}$$

where:

- D corresponds to the diameter of the waveguide chamber, expressed in millimeters.

The notions of interruption frequency and guide wavelength are detailed in particular in the document "Waveguide Handbook (IEEE Electromagnetic Waves Series 21); Author: Nathan Marcuvitz; ISBN: 0863410588; Publisher: The Institution of Engineering and Technology".

Thanks to the invention, it is possible to ignite, without difficulty, an electron cyclotron resonance plasma in a sealed chamber in which a pressure less than $10^{-4}$ mbar, advantageously between $10^{-5}$ mbar and $10^{-7}$ mbar, prevails without having to inject gas into the sealed chamber prior to the ignition of the ECR plasma. Thanks to the invention, the plasma can be ignited by the particles present in the sealed chamber.

The sealed chamber is referred to as a waveguide chamber and makes it possible to obtain a propagation of the HF wave over the entire length of the chamber. The dimensions of the sealed chamber are dependent on the frequency of the working HF wave of the ionisation device.

Thus, the diameter D of the chamber is such that the ratio $D/\lambda$ is greater than or equal to $1.841/\pi=0.59$ where $\lambda$ represents the length of the HF electromagnetic waveguide satisfying the condition of resonance.

The minimum length L of the chamber depends on the diameter and corresponds at least to the guide wavelength Lg defined by the relationship:

$$L \geq Lg = \frac{c}{\sqrt{(frequency^2_{working} - frequency^2_{interruption})}}$$

The transport of the HF electromagnetic wave is ensured by the waveguide-type sealed chamber, and it is therefore no longer necessary to maintain a minimum pressure in the plasma chamber in order to ignite and/or maintain the plasma.

The ionisation device according to the invention can be used advantageously to produce not only a compact source of multicharged ions operating at a frequency greater than 6 GHz, but also a source of monocharged or non-multicharged ions operating at low frequency, that is to say at a frequency less than 6 GHz.

The operating frequency of the ionisation device is dependent on the dimensions of the sealed chamber forming the waveguide. By way of example, for an operating frequency of 30 GHz: the diameter D of the chamber is greater than or equal to 5.9 mm, for an operating frequency of 2.45 GHz: the diameter D of the chamber is greater than or equal to 72.3 mm, and for a frequency of 1 GHz: the diameter D of the chamber is greater than or equal to 177 mm.

For a given frequency and if necessitated by the ambient or external conditions, it is possible to modify the length L of the chamber whilst ensuring that the length L is still greater than or equal to the guide wavelength Lg.

The device according to the invention can advantageously be used for ionisation of particles in gaseous phase, making it possible to control the ionised particles so as to use them for a desired purpose.

The ionisation device according to the invention may therefore advantageously be connected to another known ionisation device, such as an ion generator, in order to produce an additional ionisation function or a charged particle path control function.

The ionisation device according to the invention makes it possible to obtain ion sources that are effective, compact, economical and that can function both at high frequencies (that is to say >6 GHz) and at low frequencies (that is to say <6 GHz) depending on whether the user needs to control monocharged ions or multicharged ions.

The ionisation device according to the invention may also have one or more of the following features, considered individually or in any technically feasible combination:

said sealed vacuum chamber is a chamber in which a pressure less than $10^{-6}$ mbar prevails;

said sealed vacuum chamber is a chamber in which a pressure greater than or equal to $10^{-7}$ mbar prevails;

said sealed chamber is a circular waveguide of which the diameter D is greater than or equal to $0.59\lambda$, where $\lambda$ represents the wavelength of the injected electromagnetic wave; the diameter D is advantageously greater than 0.59 times the wavelength.

said injected electromagnetic wave is a high-frequency wave greater than or equal to 6 GHz;

said injected electromagnetic wave is a low-frequency wave less than 6 GHz;

said injection means comprise a waveguide designed to inject the high-frequency electromagnetic wave coaxially into the sealed chamber along the longitudinal axis of said sealed chamber;

said injection means comprise a waveguide designed to inject the high-frequency electromagnetic wave perpendicularly to the longitudinal axis of said sealed chamber;

said device comprises, in the vicinity of said plasma, at least one negatively polarised electrode;

said at least one electrode is hollow in its centre.

The invention also relates to an ion source comprising a sealed vacuum chamber through which high-energy ions pass, characterised in that said chamber comprises:

an ionisation device according to the invention capable of ionising neutral particles $P_n$ present inside the enclosure of the ion source;

a positively polarised electrode capable of repelling the particles $P^{n+}$ ionised by the ionisation device and capable of being transparent to high-energy ions passing through said ion source.

The expression "high-energy ions" means ions having an energy that is sufficient so as not to be stopped by the plasma; these high-energy ions preferably have an energy greater than or equal to 30 eV.

The ion source according to the invention may also have one or more of the following features, considered individually or in any technically feasible combination:

said ion source comprises an ion generator producing high-energy ions;

said positively polarised electrode is at an electric potential selected in such a way that said electric potential does not disturb the formation and/or the maintenance of the plasma of said ionisation device;

said electric potential of said positively polarised electrode is less than or equal to 15 volts;

said ion source comprises a negatively polarised electrode capable of accelerating the particles $P^{n+}$ ionised by the ionisation device;

said ion source comprises pumping means for extracting the neutral particles $P_n$ and the particles $P^{n+}$ present after neutralisation in the enclosure of said ion source;

said ion source comprises:

a sealed vacuum chamber intended to contain at least one plasma, a first and a second ionisation device according to the invention capable of ionising neutral particles $P_n$ present in the ion source; said ionisation devices being positioned on either side of said sealed chamber, an access window in said enclosure positioned between the two ionisation devices for the introduction of particles $P_n$ capable of being ionised by said ionisation devices and/or of ions I capable of interacting with the high-energy ions passing through said ion source;

a second positively polarised electrode capable of repelling the particles $P^{n+}$ ionised by the ionisation devices and capable of being transparent to the high-energy ions produced by said ion generator; said electrodes being positioned on either side of said chamber such that the particles $P_n$, $P^{n+}$ and/or the ions I remain confined between said two polarised electrodes as long as said particles $P_n$, $P^{n+}$ and/or the ions I are not redirected towards the outside of said ion source;

said ion source comprises a particle separator positioned between the ion generator and the ionisation device.

The present invention also relates to a method for igniting an electron cyclotron resonance plasma in the sealed chamber of an ionisation device according to the invention, characterised in that said plasma is ignited by the particles present in said sealed chamber without prior injection into said chamber of an igniting gas.

BRIEF DESCRIPTION OF THE DRAWINGS

Further features and advantages of the invention will become clear from the following description, which is provided by way of example and is in no way limiting, with reference to the accompanying figures, in which.

DETAILED DESCRIPTION

Figure 1:
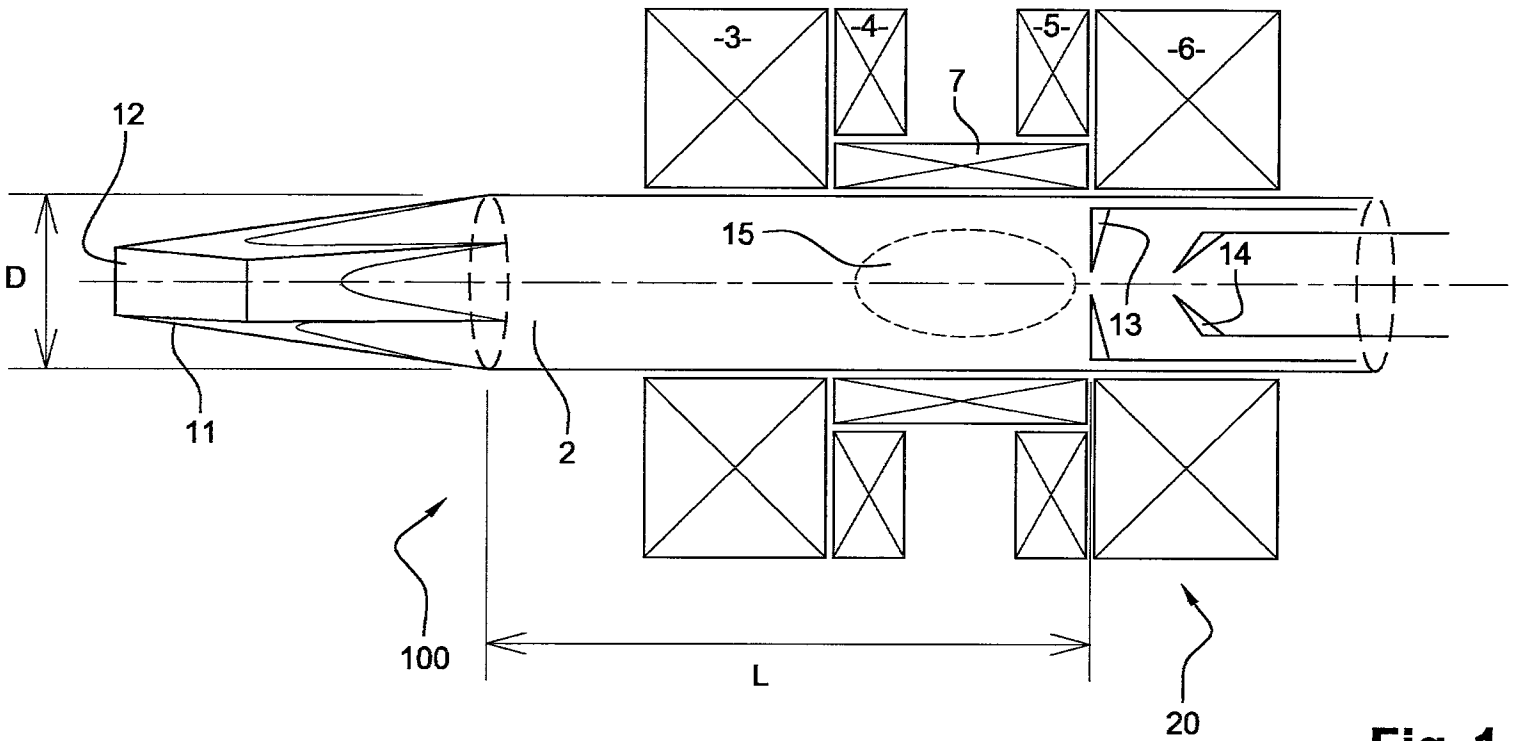
FIG. 1 is a schematic view of a first embodiment of the ionisation device according to the invention.

In all figures, like components are denoted by like reference numerals.

FIG. 1 is a schematic view of a first embodiment of the ionisation device according to the invention.

The ionisation device 100 as illustrated comprises, as is known:

a rectilinear sealed vacuum chamber 2 of circular section (referred to synonymously as an enclosure hereinafter);

rings of permanent magnets 3, 4, 5, 6, 7 arranged around the chamber 2;

coupling means 11 making it possible to couple a rectangular waveguide 12 to the chamber 2 of circular section.

The chamber 2 is a vacuum chamber, the vacuum being produced by ad hoc pumping means. In order to achieve as few impurities as possible in the chamber 2, a residual vacuum of at least $10^{-4}$ mbar is necessary. This vacuum can be lowered further however (typically as far as $10^{-7}$ mbar) in order to further reduce the number of impurities present in the chamber 2.

During operation of the ionisation device 100, the working pressure in the chamber 2 is typically equal to the residual vacuum, the residual vacuum in the chamber 2 not being disturbed or modified by a partial pressure of additional gas injected into the chamber 2, as described in patent EP 0527082.

In this first embodiment, the magnetic structure 20 is formed by the five rings of permanent magnets 3, 4, 5, 6, 7 surrounding the chamber 2. However, the magnetic structure 20 of the device 100 may also be formed by conventional coils, superconductor coils or else by an assembly formed by permanent magnets and coils making it possible to generate a magnetic field likely to create ECR conditions in the chamber 2.

The magnetic structure 20 produces an axial magnetic field inside the chamber 2, the modulus structure of said magnetic field corresponding to a magnetic mirror structure, of which the profile has at least two maxima ($B_{max}$) on the abscissas, situated respectively at the level of the permanent magnets 3 and 6 and an extended or punctiform minimum ($B_{min}$) situated between the two maxima ($B_{max}$) inside the chamber 2.

The two maxima ($B_{max}$) have a value greater than the value of the magnetic field ($B_{res}$) for which electron cyclotron resonance is achieved. The minimum ($B_{min}$) is equal to or less than the value for which electron cyclotron resonance is achieved, such that at least region in which the value of the axial magnetic field is equal to the value of the magnetic field ($B_{res}$) for which electron cyclotron resonance is achieved is produced in the chamber.

The magnetic mirror structure is a structure referred to as a minimum B structure: the electrons of the plasma 15 are confined in a magnetic well.

Thanks to the principle of electron cyclotron resonance, some of the particles will be ionised as they pass through the resonance region.

The microwaves (that is to say the HF waves) injected into the chamber 2 propagate as far as the resonance region. In fact, the transfer of energy from the injected microwave power to the plasma electrons takes place in a magnetic field location ($B_{res}$), such that electron cyclotron resonance is established, that is to say whilst there is equality between the pulsation of the high-frequency wave $\omega_{HF}$ and the cyclotronic pulsation of the electron:

$$\omega_{HF}=\omega_{ce}=q_e B_{res}/m_e$$

where $q_e$ is the electron charge (Cb);

$B_{res}$ is the magnetic field corresponding to the resonance (T);

$m_e$ is the mass of the electron.

A microwave generator (not illustrated) is placed outside the chamber 2; this generator injects high-frequency (HF) waves into the chamber 2 via the coupling means 11 making it possible to couple the waveguide 12 of the microwave generator to the waveguide-type chamber 2.

In this first embodiment, the coupling means 11 make it possible to couple the rectangular waveguide 12 to the waveguide-type chamber 2 of circular section.

In accordance with a further embodiment, the coupling means may make it possible to couple a circular waveguide positioned coaxially with the circular chamber 2.

The chamber 2 forms a circular waveguide, such that the HF wave is transported over the entire length L of the chamber 2, and in particular as far as a point of the chamber 2 where the ECR conditions are combined for the formation of the plasma 15.

The coupling, or the transition, between the waveguides of the microwave generator and the waveguide-type chamber 2 is performed along the longitudinal axis of the circular waveguide formed by the chamber 2.

The sealed chamber 2 being what is referred to as a waveguide chamber, it enables the transport of the HF wave and therefore makes it possible to avoid the use of a means for injecting HF waves into the plasma chamber as close as possible to the region in which the ECR conditions are combined.

The dimensions of the chamber 2, that is to say the diameter D and the length L, are dependent on the working resonance frequency of the device. The diameter D of the chamber 2 is determined so as to meet the following condition:

$$\text{frequency}_{working} > \text{frequency}_{interruption} \quad (1)$$

The minimum length L of the chamber corresponds at least to the "guide" wavelength Lg, that is to say:

$$Lg = \frac{c}{\sqrt{(frequency^2_{working} - frequency^2_{interruption})}} \quad (2)$$

The dimensions of the confinement enclosure confining the plasma are therefore only limited by the minimum dimensions of a rectangular or circular waveguide corresponding to the electromagnetic frequency used.

The space in which the plasma 15 is created is located in a section of the rectilinear chamber 2 of circular section in which the ECR conditions are combined. Physically, there is no geometrical discontinuity between the ECR plasma region and the rest of the chamber 2 forming the waveguide. The chamber 2 is formed by a tube of which the maximum length is not defined, but of which the minimum length must be equal to or greater than the guide wavelength according to relationship (2).

The device illustrated in FIG. 1 is characterised by the absence of a negatively polarised device (tube, ring, metal piece) normally present at the point of injection as close as possible to the plasma. The negative polarisation at the point of injection generally makes it possible to optimise the performances of the ionisation device or of the ion source, in particular with regard to the production of multicharged ions. However, in the case of a waveguide-type chamber as described, the presence of a negatively polarised device or of another performance optimisation system would disturb the propagation of the HF wave in the chamber 2.

By contrast and in order to optimise the performances of the device, the ionisation device according to the invention may comprise a negatively polarised plasma electrode 13 situated at the point of extraction of ions from the ionisation device. The plasma electrode 13 is negatively polarised with respect to the chamber 2 at a potential difference of a few volts to 500 V, and possibly above.

The device may also comprise a negatively polarised acceleration electrode 14 for accelerating the particles ionised to the desired energy. The acceleration electrode 14 is advantageously polarised at a potential difference of approximately a few hundred volts to several tens of thousands of volts).

Advantageously, the rectilinear shape of the chamber 2, which may be of great length, makes it possible to adapt the positioning of the magnetic structure 20 relative to the chamber 2 so as to place the region for heating the electrons and consequently the plasma in accordance with the needs of the user.

This feature provides the possibility for example of optimising the position of the region where the ECR conditions are combined relative to the plasma electrode, relative to an optical system, such as beam adjustment lenses, the positioning relative to an experimental space, or else relative to a determined physical system, making it possible for example to provide a mobile magnetic system for the disassembly of the device.

The ionisation device 100 according to the invention conventionally comprises access points, which are formed on the chamber 2 for the introduction of gas, for extraction or for the control of ions, etc.

Figure 2:
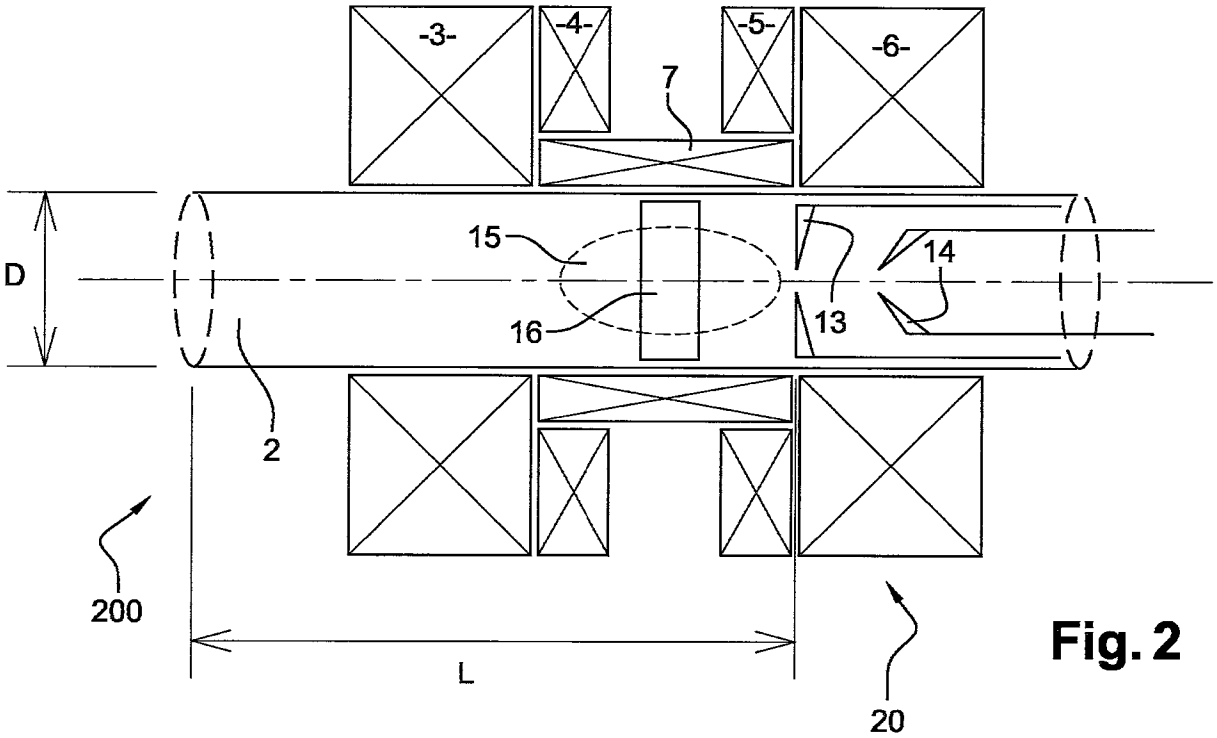
FIG. 2 is a schematic view of a second exemplary embodiment of the ionisation device according to the invention.

FIG. 2 is a variant of the proceeding figure (the means common to the devices 100 and 200 bear the same reference numerals and perform the same functions). The device 200 according to this second embodiment differs from the device 100 in FIG. 1 in that the high-frequency (HF) waves are introduced laterally into the chamber 2 via a rectangular waveguide 16. In this variant, the HF wave is therefore introduced into the chamber 2 perpendicularly to the longitudinal axis of said chamber via a waveguide 16 leading directly to the plasma chamber 2 or else via a coaxial transition with the chamber 2. A sealed HF window or HF passage makes it possible to maintain the vacuum in the plasma chamber 2.

Figure 3:
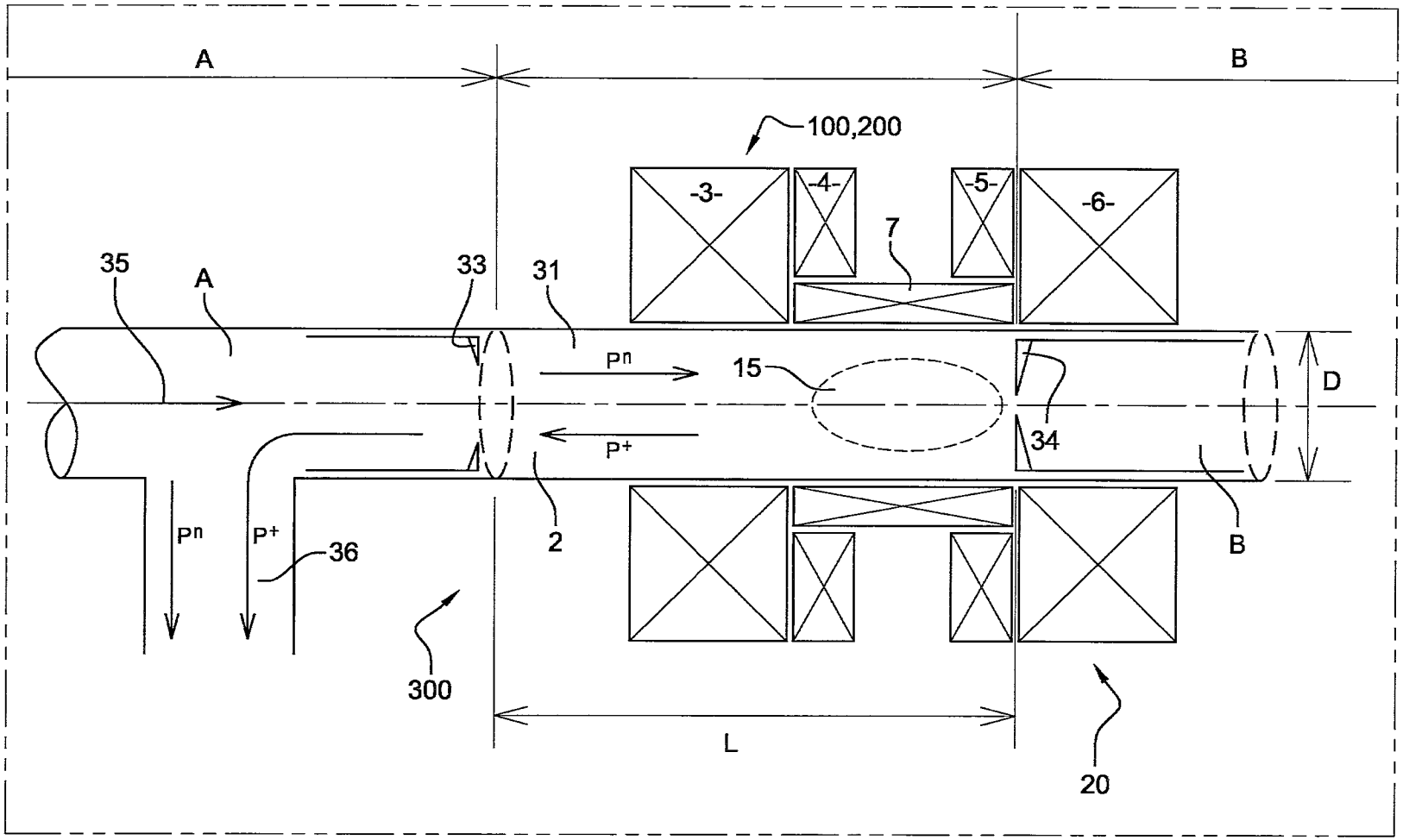
FIG. 3 is a schematic view of a first example of use of the ionisation device illustrated in FIGS. 1 and 2 as a particle filter in a line of transport of high-energy charged particles.

FIG. 3 is a schematic view of a first example of use of the ionisation device illustrated in FIGS. 1 and 2. In this first example, the ionisation device 100, 200 is used as a particle filter by means of ionisation in a line of transport 300 of high-energy charged particles 35.

In this first example of use, the system is a line of transport 300 of a beam of high-energy ions, in which the device 100, 200 according to the invention is incorporated.

In this example, the ionisation device 100, 200 is used over a line of transport 300 of a beam of high-energy ions from an ion source in order to extract the undesirable particles that may pollute or alter the quality of the beam of ions or that may pollute the devices downstream in the line of transport.

The principle lies in using the device 100, 200 according to the invention to ionise the neutral particles present in the line of transport 300 so as to control their path and in particular repel them so as to prevent the neutral particles from polluting the beam of multicharged ions, in particular at the point of extraction of the ions, but also in order to prevent these neutral particles from migrating from the enclosure A to the enclosure B of the line of transport 300 (FIG. 3).

To this end, the line of transport 300 is formed in particular by:

- a first vacuum enclosure A;
- a second vacuum enclosure B positioned in the continuity of the first enclosure A and coaxially therewith;
- an ionisation device 100, 200 according to the invention comprising a chamber 31 positioned coaxially between the chamber A and the chamber B such that the enclosures A and B and the chamber 31 of the ionisation device 100, 200 form a physical continuity;
- an exit window 36 present in the enclosure A for extraction of the polluting neutral particles, that is to say of the undesirable particles in the line of transport 300.

The direction of circulation of the high-energy ions produced in the line of transport 300 is represented by the continuous arrow 35 illustrated in FIG. 3. The high-energy ions pass through the system from one end to the other by passing from the enclosure A to the enclosure B.

The chamber 31 meets the previously described conditions with regard to diameter and length such that the chamber 31 forms a sealed waveguide-type vacuum chamber.

In accordance with a further embodiment, the line of transport is formed by a single vacuum enclosure divided into a number of regions in accordance with the previously described division.

The magnetic structure 20 of the ionisation device 100, 200 is positioned such that ECR conditions are present in a part of the chamber 31, leading to the formation of an ECR plasma. The chamber 31 and the magnetic structure thus form the ionisation device 100, 200.

It is necessary for the chamber 31 to meet the conditions with regard to diameter and length of the waveguide corresponding to the working frequency. Beyond the chamber 31, the enclosure A and the enclosure B may have different shapes in order to adapt to different usage requirements.

The neutral particles $P_n$ present in the enclosure A move towards the ionisation device 100, 200 and more specifically towards the chamber 31 presenting the ECR conditions and in which the plasma 15 is maintained.

The neutral particles $P_n$ are then ionised into particles $P^{n+}$ by the plasma 15 of the ionisation device 100, 200.

Once the neutral particles $P_n$ have been ionised into particles $P^{n+}$, their paths can therefore be controlled for example by the use of a plurality of polarised diaphragms or of polarised electrodes arranged on either side of the plasma 15.

In the first example of use, the ionisation device 100, 200 is connected to a polarised electrode 34, which is positively polarised, measuring a few volts and is positioned after the ECR region, that is to say downstream of the plasma 15 with respect to the direction indicated by the arrow 35 symbolising the displacement of high-energy ions.

The electrode 34 therefore serves as a separation between the enclosure A/chamber 31 assembly, which may comprise a multitude of undesirable particles resulting for example from incomplete primary ionisation, and the enclosure B, in which the beam of ions is purified and the undesirable particles ionised in the chamber 31 by the plasma 15 of the ionisation device are then repelled into the enclosure A by the polarised electrode 34.

In fact, the positively polarised electrode 34 will repel the ionised particles $P^{n+}$ by repulsion into the chamber 31. These ionised particles $P^{n+}$ are neutralised and then extracted towards the enclosure A and are removed via the exit window 36, such that the volatile particles do not pollute the enclosure B together with the beam of high-energy ions exiting from the line of transport 300.

In addition, any residual neutral particles $P_n$ present in the enclosure B can pass freely from the enclosure B to the enclosure A. In this case, the neutral particles $P_n$ originating from the enclosure B will also be ionised into charged particles $P^{n+}$ by the plasma 15 in the chamber 31 and then sent into the enclosure A by the polarised electrode 34.

The electrode 34 is weakly polarised, that is to say that the potential difference at the terminals of the electrode is selected so as not to disturb the formation and maintenance of the plasma 15. The potential difference at the terminals of the electrode is advantageously less than or equal to 5 volts.

An advantage of the weakly polarised electrode 34 is that it does not repel the high-energy ions that have sufficient energy to pass through the polarised electrode 34.

The beam of high-energy ions 35 likewise is not disturbed by the plasma 15, which is a low-density plasma.

The ionised particles $P^{n+}$ trapped in the enclosure A are then pumped, after neutralisation with the walls, by an ad hoc pumping system (not illustrated) via the exit window 36 formed in the enclosure A upstream of the plasma chamber 31.

In order to increase the efficacy of the system, it is also possible to add a second polarised electrode 33 upstream of the plasma 15. This time, the electrode 33 is negatively polarised such that it accelerates the ionised particles $P^{n+}$ in the direction opposite the movement of the high-energy ions so as to guide more easily the undesirable ionised particles towards the pumping system.

The ionisation device 100, 200, in this application, thus makes it possible to limit the effusion of the neutral particles $P_n$ from a first enclosure to a second enclosure, whereas the two enclosures communicate physically together, that is to say they constitute a physical continuity. In this example of use, the efficacy of the system is greater than 90% thanks to the additional use of a polarised electrode arranged downstream of the plasma.

In this first example of use, the ionisation device is advantageously an ionisation device 200 comprising a lateral introduction of high-frequency waves into the chamber 31, as described with reference to FIG. 2. However, an axial introduction of high-frequency waves coaxially into the chamber 31 is also possible.

The controlled effusion of the particles in gaseous phase, as described with reference to FIG. 3, can thus also be used for:

- molecular isolation of vacuum enclosures;
- the pumping of gases whilst avoiding effusion thereof into other enclosures;
- recycling, recovery, concentration or reuse of particles in gaseous phase necessary for a specific process;
- the replacement of the use of complex cryogenic technology with cryogenic panels for selective trapping of particles or use thereof in a complementary manner.

Figure 4:
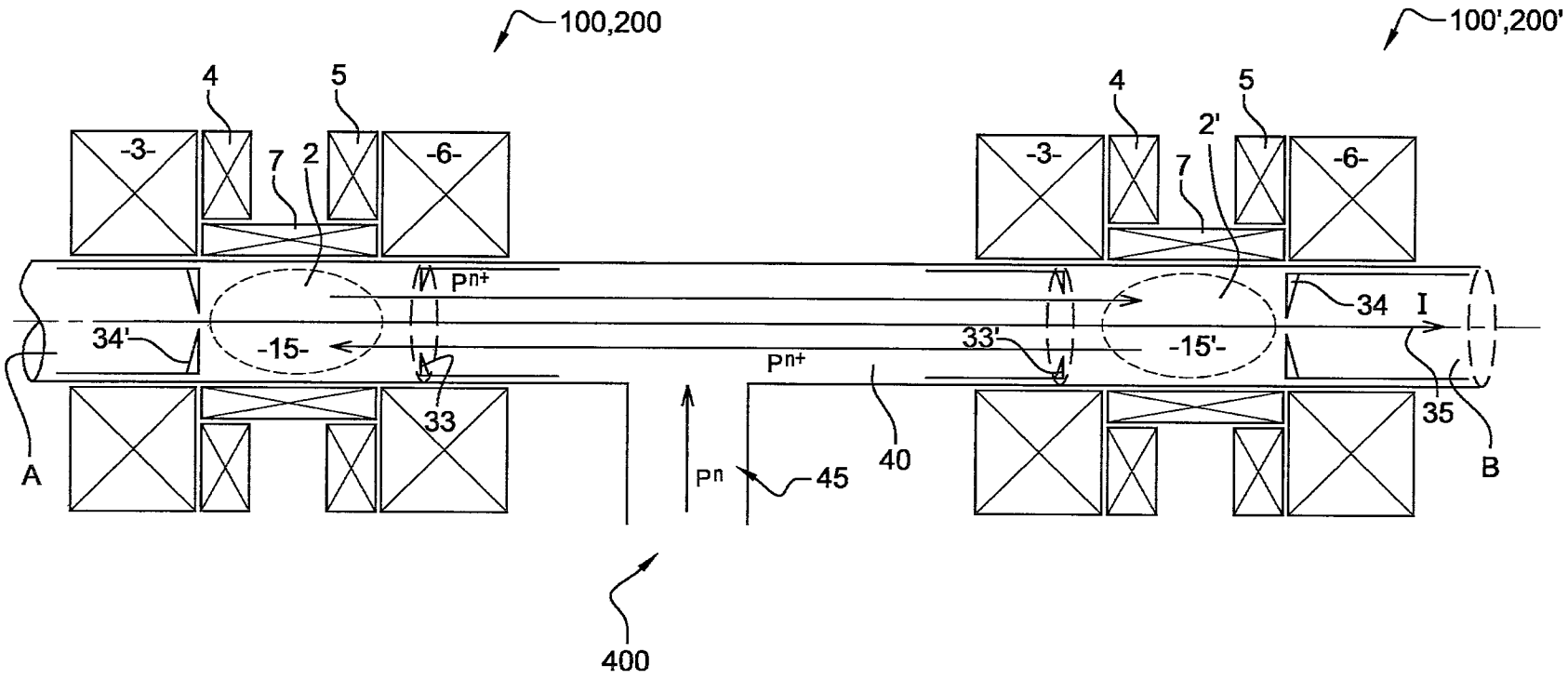
FIG. 4 is a schematic view of a second example of use of the ionisation device illustrated in FIGS. 1 and 2 making it possible to significantly increase the likelihood of interactions between the neutral or ionised particles.

FIG. 4 is a schematic view of a second example of application or use of the ionisation device described beforehand with reference to FIGS. 1 and 2. In this example, the ionisation device is used to increase the probability of interaction between a beam of high-energy ions I and neutral particles $P_n$ or charged particles $P^{n+}$ oscillating between two ionisation devices 100, 200 according to the invention.

In accordance with a further embodiment of the invention, the ionisation device according to the invention may also be used to increase the probability of interaction between a beam of high-energy ions I and ions.

In this second example of application, two ionisation devices 100, 200 and 100', 200' are combined on either side of an intermediate vacuum chamber 40 between an enclosure A and an enclosure B. Each of the two ionisation devices 100, 200 and 100', 200' comprises a vacuum chamber 2 and 2', said chambers 2 and 2' forming the ends of the intermediate chamber 40.

Upstream of the intermediate vacuum chamber 40, an enclosure A is located, through which a beam of multicharged ions 35 is moved. The beam of ions 35 is produced by an ion generator situated upstream of the enclosure A and passes through the system 400 from one end to the other with a view to reaching the vacuum enclosure B.

To this end, the beam of high-energy ions produced by the ion generator passes through a first, low-density plasma 15 of the first ionisation device 100, 200, and then through a second low-density plasma 15' of the second ionisation device 100', 200' in order to reach the vacuum enclosure B.

Similarly to the system described before with reference to FIG. 3, the delimitation between the intermediate vacuum chamber 40 and the vacuum enclosure B is implemented by a polarised electrode 34, as described beforehand, and the delimitation between the intermediate vacuum chamber 40 and the vacuum enclosure A is implemented by a second polarised electrode 34'. The polarised electrode 34 is situated upstream of the vacuum chamber 2 of the first ionisation device 100, 200, and the polarised electrode 34' is arranged downstream of the vacuum chamber 2' of the second ionisation device 100', 200'. The polarised electrodes 34 and 34' are thus used to repel the ionised particles $P^{n+}$ weakly charged by the plasmas 15 and 15' and thus to extract said particles in the vacuum chamber 40 via the electrodes 33, 33' whilst allowing high-energy ions to pass into the vacuum enclosure B.

The chamber 40 is a sealed chamber of which the dimensions and the shape meet the previously described waveguide conditions in the regions where the ECR conditions are combined. In the central region of the vacuum chamber 40, that is to say between the two ionisation devices 100, 200 and 100', 200' the chamber 40 comprises an entry window 45, making it possible to inject neutral particles $P_n$ or ions I into the chamber 40. The injected neutral particles $P_n$ will move towards the plasmas 15, 15' of the ionisation devices 100, 200, 100', 200'.

In accordance with the embodiment in which the ionisation device is used to increase the probability of interaction between the beam of high-energy ions 35 and the ions, the entry window 45 makes it possible to inject the weak-energy ions into the plasma chamber. The weak-energy ions will then pass, after neutralisation, towards the plasmas 15, 15' of the ionisation devices 100, 100' and 200, 200'.

In order to increase the efficacy of the system, it is also possible to add polarised electrodes 33, 33' close to the plasmas 15, 15' and opposite the polarised electrodes 34, 34'. The electrodes 33, 33' are negatively polarised such that they cause an acceleration of the ionised particles $P^{n+}$ into the chamber 40 towards the opposed plasma.

The described system 400 thus makes it possible to:

- control the quality and the quantity of the atomic and molecular population in the chamber 40 between two ionisation devices 100, 100' and 200, 200';
- control the efficacy of a reaction between injected particles and other elements: the unreacted particles are sent back between the two plasmas until they interact with other elements;
- reduce or increase the molecular flux of the vacuum system by using the particle ionisation devices. In this specific case, the path of the ionised particles $P^{n+}$ is controlled, thus making it possible to modify the fluxes of particles imposed by the conductances on a molecular level.

Figure 5:
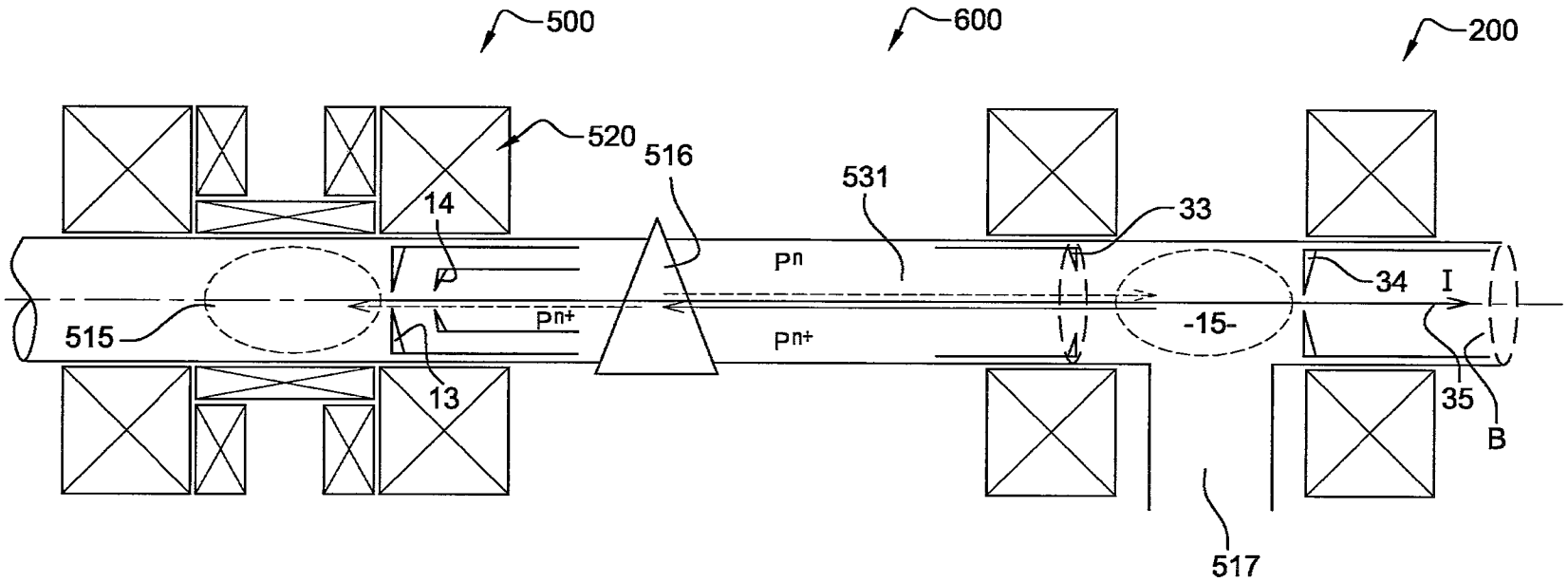
FIG. 5 is a schematic view of a third example of use of the ionisation device illustrated in FIGS. 1 and 2 making it possible to increase the yield of an ion generator for a given charged state.

FIG. 5 is a schematic view of a third example of use of the ionisation device described with reference to FIGS. 1 and 2 making it possible for the volatile elements to increase the yield of an ion generator for a given charge state.

In the specific case of ECR ion sources, some of the gas in question cannot be totally ionised by the plasma of the ion generator 500, and some ions of interest may be neutralised during the recombination of ions by collision with neutral particles of the non-ionised gas or else by impact of ions with the walls of the ion generator 500, which, as a result, reduces the efficacy of the ion generator 500.

The system 600 comprising an ionisation device 100 or 200 downstream of the ion generator 500 makes it possible to reinject the particles of the gas of interest into the ion generator 500 in order to increase the efficacy thereof.

In fact, thanks to the ionisation device 100, 200 according to the invention, the neutral particles $P_n$ produced from the non-ionised gases, the ions of interest I+ neutralised by collision with the walls, or else the ions not exhibiting a good mass/charge ratio in the case of a source of multicharged ions are sent back towards the ion generator 500.

In this example of use, the ionisation device is advantageously an ionisation device 200 comprising a lateral introduction of high-frequency waves via a window 517 in the plasma chamber 531, as described with reference to FIG. 2. However, an axial introduction of high-frequency waves coaxially into the chamber 531 is also possible. In the case of a generator of multicharged ions, the ions not exhibiting a good mass/charge ratio are sent back towards the ion generator 500 after separation and neutralisation by means of a separator such as a mass spectrometer 516 or other known separator positioned between the ion generator 500 and the ionisation device 200.

With regard to neutral particles $P_n$ produced from the non-ionised gas or originating from neutralised ions by impact against the walls or with other elements present in the chamber 531, these are ionised into particles $P^{n+}$ by the weak-density plasma 15 of the ionisation device and are then repelled as far as the plasma chamber 515 of the ion generator 500 by means of a polarised electrode 34, which is positively polarised and is positioned downstream of the plasma 15 and of a negatively polarised acceleration electrode 33.

Other means for returning particles ionised by the plasma can be used, such as a pump. A particle of gas of interest may thus undergo a number of cycles of ionisation-neutralisation-ionisation before obtaining the desired charge state.

The device according to the invention enables effective transformation, that is to say without loss, of the injected gas into ions of interest preferably having a single charge state possibly obtained by a number of ionisation-neutralisation-ionisation cycles. The ions produced with this principle are thus ionised at different times, but have the same origin and the same energy.

The system 600 as described would thus be adapted to the production of costly isotopic ions or else for the use of dangerous gases as support gases or as gases of interest.

For the same flow of gas injected into any ion generator, the ionisation device according to the invention thus makes it possible to increase its ionisation efficacy over a given charge state. The ionisation device according to the invention therefore makes it possible to easily remedy the low efficacy of ionisation of an ion generator, of whatever type, whilst avoiding significant costs and installation problems of such a generator.

The invention has been described in particular with the injection of an HF electromagnetic wave, that is to say greater than or equal to 6 GHz, however, the invention can also be applied with an electromagnetic wave referred to as low-frequency (RF type) less than 6 GHz as long as the condition L>Lg is observed.

It will be noted that the electrodes 13 and 14 and/or the electrodes 33 and 34 are advantageously hollow in their centre.

Of course, the invention is not limited to the embodiments described here.

The invention claimed is:

1. An electron cyclotron resonance ionisation device, comprising:

- a sealed vacuum chamber;
- an electromagnetic wave injector configured to inject an electromagnetic wave into said sealed vacuum chamber;
- a magnetic structure for producing a magnetic field in said sealed vacuum chamber and for generating a plasma along the magnetic field lines, the modulus of said magnetic field forming a magnetic mirror structure having a magnetic field profile that includes two maxima and a minimum between the two maxima, wherein the minimum of the magnetic field profile is equal to or less than a value for which electron cyclotron resonance is achieved so that at least one electron cyclotron resonance region is formed in the chamber;

said sealed vacuum chamber being a waveguide having a length greater than or equal to a guide wavelength corresponding to a frequency of the injected electromagnetic wave, wherein said sealed vacuum chamber comprises a plasma ignited without prior injection of gas, said sealed vacuum chamber being a chamber in which a pressure less than $10^{-4}$ mbar prevails.

2. The ionisation device according to claim 1, wherein said sealed vacuum chamber is a chamber in which a pressure less than $10^{-6}$ mbar prevails.

3. The ionisation device according to claim 2, wherein said sealed vacuum chamber is a chamber in which a pressure greater than or equal to $10^{-7}$ mbar prevails.

4. The ionisation device according to claim 1, wherein said sealed vacuum chamber is a circular waveguide having a diameter greater than or equal to 0.59λ, where λ represents the wavelength of the injected electromagnetic wave.

5. The ionisation device according to claim 1, wherein said injected electromagnetic wave is a high-frequency wave greater than or equal to 6 GHz.

6. The ionisation device according to claim 1, wherein said injected electromagnetic wave is a low-frequency wave less than 6 GHz.

7. The ionisation device according to claim 1, wherein said electromagnetic wave injector comprises a waveguide arranged to inject the high-frequency electromagnetic wave coaxially into the sealed vacuum chamber along the longitudinal axis of said sealed vacuum chamber.

8. The ionisation device according to claim 1, wherein said electromagnetic wave injector comprises a waveguide arranged to inject the high-frequency electromagnetic wave perpendicularly to the longitudinal axis of said sealed vacuum chamber.

9. The ionisation device according to claim 1, comprising, in the proximity of said plasma, at least one negatively polarised electrode.

10. The device according to claim 9, wherein said at least one electrode is hollow in its centre.

11. An ion source comprising:

a vacuum enclosure through which high-energy ions pass;

an ionisation device according to claim 1 capable of ionising neutral particles present inside the vacuum enclosure; and a positively polarised electrode capable of repelling the particles ionised by the ionisation device and capable of being transparent to the high-energy ions passing through said ion source.

12. The ion source according to claim 11, wherein said positively polarised electrode is at an electric potential selected such that said electric potential does not disturb the formation and/or the maintenance of the plasma of said ionisation device.

13. The ion source according to claim 12, wherein said electric potential of said positively polarised electrode is less than or equal to 15 volts.

14. The ion source according to claim 11, comprising a negatively polarised electrode capable of accelerating the particles ionised by the ionisation device.

15. The ion source according to claim 11, comprising an ion generator producing high-energy ions.

16. The ion source according to claim 11, wherein said ion source comprises a pumping arrangement configured to extract the neutral particles and the particles present after neutralisation in the enclosure of said ion source.

17. The ion source according to claim 11, comprising:

an intermediate sealed vacuum chamber;

a first and a second ionisation device capable of ionising neutral particles present inside the ion source; said first and second ionisation devices being positioned on either side of said intermediate sealed vacuum chamber;

an access window in said intermediate vacuum chamber positioned between the first and second ionisation devices for the introduction of particles capable of being ionised by said first and second ionisation devices and/or ions capable of interacting with high-energy ions passing through said ion source;

a second positively polarised electrode capable of repelling the particles ionised by the first and second ionisation devices and capable of being transparent to the high-energy ions; said first electrode being positioned upstream of the sealed vacuum chamber of said first ionisation device and said second electrode being positioned downstream of the sealed vacuum chamber of said second ionisation device such that the particles and/or the ions remain confined between said two polarised electrodes as long as said particles and/or the ions are not redirected towards the outside of said ion source.

18. The ion source according to claim 15, comprising a particle separator positioned between the ion generator and the ionisation device.

19. A method for igniting an electron cyclotron resonance plasma in the sealed vacuum chamber of an ionisation device, the method comprising igniting said plasma by particles present in said sealed vacuum chamber without prior injection into said chamber of an igniting gas, wherein said ionisation device includes the sealed vacuum chamber;

an electromagnetic wave injector configured to inject an electromagnetic wave into said sealed vacuum chamber;

a magnetic structure for producing a magnetic field in said sealed vacuum chamber and for generating a plasma along the magnetic field lines, the modulus of said magnetic field forming a magnetic mirror structure having a magnetic field profile that includes two maxima and a minimum between the two maxima, wherein the minimum of the magnetic field profile is equal to or less than a value for which electron cyclotron resonance is achieved so that at least one electron cyclotron resonance region is formed in the chamber;

said sealed vacuum chamber being a waveguide having a length greater than or equal to a guide wavelength corresponding to a frequency of the injected electromagnetic wave, wherein said sealed vacuum chamber comprises a plasma ignited without prior injection of gas, said sealed vacuum chamber being a chamber in which a pressure less than $10^{-4}$ mbar prevails.

* * * * *